US006428227B2

(12) United States Patent
Petteruti et al.

(10) Patent No.: US 6,428,227 B2
(45) Date of Patent: Aug. 6, 2002

(54) THERMAL PRINTER

(75) Inventors: Steven F. Petteruti, East Greenwich; Richard Preliasco, North Kingstown, both of RI (US); Michael DiGiantommaso, Sutton, MA (US); Majid Amani, Coventry; David St. Jean, Chepachet, both of RI (US)

(73) Assignee: ZIH Corporation, Warwick, RI (US)

( * ) Notice: Subject to any disclaimer, the term of this patent is extended or adjusted under 35 U.S.C. 154(b) by 0 days.

(21) Appl. No.: 09/875,700

(22) Filed: Jun. 6, 2001

Related U.S. Application Data

(62) Division of application No. 08/757,244, filed on Nov. 27, 1996, now Pat. No. 6,261,009.

(51) Int. Cl.[7] ..... B41J 3/39

(52) U.S. Cl. ..... 400/691; 400/692; 347/222

(58) Field of Search ..... 400/691, 692, 400/693, 120.16, 120.17; 347/220, 222

(56) References Cited

U.S. PATENT DOCUMENTS

| | | | | |
|---|---|---|---|---|
| 4,507,666 A | * | 3/1985 | Kondo et al. | 347/198 |
| 4,614,949 A | | 9/1986 | Hakkaku et al. | 346/76 |
| 4,685,815 A | * | 8/1987 | Baranyi | 400/120.16 |
| 4,896,166 A | | 1/1990 | Barker et al. | 346/76 PH |
| 4,910,602 A | | 3/1990 | Sakuragi | 358/296 |
| 4,938,616 A | | 7/1990 | Shiozaki et al. | 400/120 |
| 4,947,185 A | | 8/1990 | Mitsushima et al. | 346/76 PH |
| 4,962,392 A | | 10/1990 | Okuno et al. | 346/145 |
| 5,014,073 A | | 5/1991 | Sone et al. | 346/76 PH |
| 5,036,338 A | | 7/1991 | Imai | 346/76 PH |
| 5,040,461 A | * | 8/1991 | Van-Ocker | 400/232 X |
| 5,150,130 A | | 9/1992 | Sato | 346/76 PH |
| 5,265,966 A | | 11/1993 | Schmidt | 400/55 |
| 5,267,800 A | | 12/1993 | Petteruti et al. | 400/88 |
| 5,326,182 A | | 7/1994 | Hagstrom | 400/223 |
| 5,366,302 A | | 11/1994 | Masumura et al. | 400/120.16 |
| 5,401,352 A | * | 3/1995 | Matsushita et al. | 156/384 |
| 5,402,528 A | * | 3/1995 | Christopher et al. | 400/63 |
| 5,447,380 A | | 9/1995 | Colonel et al. | 400/120.01 |
| 5,488,223 A | | 1/1996 | Austin et al. | 235/375 |
| 5,497,450 A | | 3/1996 | Helmbold et al. | 395/114 |
| 5,503,483 A | | 4/1996 | Petteruti et al. | 400/88 |
| 5,516,219 A | * | 5/1996 | Leonard et al. | 400/613 |
| 5,520,776 A | | 5/1996 | Van Allen et al. | 156/584 |
| 5,580,177 A | * | 12/1996 | Gase et al. | 400/61 |
| 5,873,659 A | * | 2/1999 | Edwards et al. | 400/61 |
| 5,887,990 A | * | 3/1999 | Card et al. | 400/61 |
| 5,895,155 A | * | 4/1999 | Narita et al. | 400/61 |

OTHER PUBLICATIONS

Datamax Bar Code Products Corporation; *Ovation Operator's Manual*; Cover page, Revision–A, and p. 8; (1995).

* cited by examiner

*Primary Examiner*—Andrew H. Hirshfeld
*Assistant Examiner*—Minh Chau
(74) *Attorney, Agent, or Firm*—Testa, Hurwitz & Thibeault, LLP

(57) ABSTRACT

A thermal label printer includes an actuation mechanism and follower for facilitating loading of stock (e.g., label stock). A pivotable printer head pressure plate includes the actuation mechanism which cooperates with the follower coupled to a peeler roller. As the pressure plate is moved from a closed position proximate a platen to an open position for loading of stock or for cleaning the printer head, the peeler roller is automatically translated from the platen. The resulting roller gap and displaced printer head provide unrestricted access for threading of the printer. The printer also includes a programmable device in the printer electronics for reconfiguring the printer to accommodate a variety of thermal print mechanisms.

14 Claims, 12 Drawing Sheets

THERMAL PRINTER

CROSS-REFERENCE TO RELATED APPLICATION

This application is a divisional application of, and claims priority to, U.S. patent application Ser. No. 08/757,244, filed Nov. 27, 1996, now U.S. Pat. No. 6,261,009 the disclosure of which is incorporated herein by reference in its entirety.

TECHNICAL FIELD

The present invention relates to printers and, more specifically, to a mechanical arrangement for automatically displacing a roller from a platen upon opening a printer head pressure plate. The automatic displacement feature facilitates the loading of stock (e.g., label stock) in the printer. Other aspects of the invention include the ability of the printer to be readily and easily reconfigured to accommodate an optional thermal ribbon cartridge and a variety of thermal print mechanisms.

BACKGROUND

Thermal printers are used increasingly in retail, warehouse, and other locations to generate adhesive labels for marking goods to facilitate identification, tracking, and pricing. Due to the print quality, accuracy, and versatility of dot matrix or array type thermal print mechanisms, a wide variety of information can be produced quickly and inexpensively on the labels as the need arises. Lot sizes of labels can be as small as one or as large as several hundred or more, depending upon the particular application. Printer electronics integral with the printer may include a microprocessor, memory, and associated internal and external communications so that the printer can be used to create alphanumeric characters of varying size, font, and orientation, stylized graphical markings such as logotypes and trademarks, and machine readable indicia such as bar codes for the particular goods to be labeled. A variety of these characters, markings, and indicia can be printed in combination on a single label.

Thermal printers can print on thermal paper which darkens or changes color when heated above a threshold temperature by the thermal print mechanism or printer head. By selectively activating discrete thermal elements in the printer head array as the thermal paper passes by, the desired information can be reproduced on the thermal paper. To provide intimate, uniform contact between the printer head and the label, the label is passed typically through a nip formed by the printer head and a powered rubber platen roller. The platen may be used to drive the label through the nip. Instead of heating the label, a thermal transfer ribbon having a layer of dried ink on a thin backing sheet can be disposed between the printer head and a paper label on the platen. As the printer head is heated above the ribbon ink threshold temperature, the ink melts and is transferred to the label where it dries and forms an indelible marking of the desired information.

"Label stock" generally includes a series of printable surfaces of paper or other label material adhesively and releasably attached to a web carrier backing. The label stock typically is manufactured in roll form for continuous feeding through a thermal printer. "Linerless" label stock is also commercially available which is in the form of a roll of continuous adhesive strip. Special handling of this stock is required to prevent misfeeding and jamming of the thermal printer. For example, a silicone platen roller may be used to prevent adhesion of the stock thereto and a cutter mechanism may be provided to separate a printed label portion from the remaining roll.

In printers for printing on a series of labels adhered to a web, it may be desirable to dispense printed labels individually, wholly or partially delaminated from the web, to facilitate removal by an operator. By passing the web across a peeler bar at an acute angle after discharge from the nip formed between the printer head and platen, a leading edge of the label becomes delaminated or detached from the web. An additional roller may be provided biased against the platen or other roller to form a second nip through which solely the web passes. By keeping the web taut and maintaining close conformance of the web to the peeler bar, reliable dispensing of the printed labels may be ensured.

When initially threading the printer with the label stock, the stock must be passed through the printer head nip and, if the peeler bar is to be used, the web also must be passed through the roller nip. The web should be taut between the printer head nip and the roller nip to tightly conform the web to the peeler bar. Various arrangements are known for providing a gap between the printer head and platen to facilitate loading. For example, see U.S. Pat. Nos. 5,014,073 and 5,150,130. Known arrangements for providing a gap between a roller and a platen to facilitate removal of paper jams include the arrangement disclosed in U.S. Pat. No. 4,947,185. Arrangements that require manual actuation to provide a gap between the roller and the platen include a spring loaded roller with bi-stable positioning so that the roller is stable in positions both against the platen as well as spaced therefrom. Manual actuation is required both to displace the roller from the platen as well as return the roller to the contact position. Each of these arrangements entails separate apparatus for displacing a printer head and a roller from the platen.

SUMMARY OF THE INVENTION

It is an object of the invention to provide a printer which has an improved stock (e.g., label stock) loading feature.

It is another object of the invention to provide a printer that is readily and easily reconfigurable to accommodate an optional thermal ribbon cartridge and a variety of thermal print mechanisms.

An improved printer and printer subassembly according to the invention are useful in a wide variety of applications including, but not limited to, thermal printing on label stock. The printer subassembly includes a powered platen having an axis of rotation. A thermal print mechanism, including a printer head, is aligned with and biased against the platen by a stacked assembly of a pressure plate and an alignment plate with springs disposed therebetween. The printer head is fixedly mounted on the alignment plate which is supported by the pressure plate using a pivot feature in combination with a centering feature ensuring proper alignment of the printer head relative to the platen.

The pressure plate is hinged about an axis along an edge perpendicular to the platen axis. A latch disposed along an opposite edge of the pressure plate maintains the plate in a closed position for printing. The latch may include a microswitch to signal a printer controller that the pressure plate is closed and printing can begin if the printer is otherwise ready. Releasing the latch permits the pressure plate to be swung open providing access to load label stock as well as clean or remove the printer head.

The pressure plate includes an actuation mechanism proximate the hinge axis which cooperates with a follower. The follower is coupled to a roller biased against the platen to effect translation of the roller as the follower is moved. The actuation mechanism may be a cam sector with a fixed radial dimension and a varying axial dimension. The follower may be a cantilevered arm with a pin for sliding contact on the sector. As the pressure plate is moved from a closed to an open position, the follower pin slides along the contoured surface of the cam sector, translating the roller from a position biased against the platen to a position spaced therefrom. Accordingly, with the pressure plate in an open position, a gap is formed between the roller and the platen. After passing the label stock over the platen and a peeler bar, the web may be passed through the gap and held taut. As the pressure plate is closed and latched, the label stock is captured between the printer head and the platen and the web is captured between the roller and the platen. The label stock may then be advanced automatically or manually to align a leading edge of a label with the printer head for printing.

A detent in the cam sector corresponding to a fully open position of the pressure plate may be provided for engagement with the follower pin to keep the pressure plate in the open position during label stock loading. To provide parallel translation of the roller relative to the platen, cam surfaces may be affixed to both ends of the roller. The follower may also include an optional extension for manual translation of the roller when the pressure plate remains in a closed position. A frame supporting the roller may include slots to limit manual translation of the roller within predetermined limits.

The modular design of the interface between the pressure plate and the alignment plate permits rapid manual replacement or swapping of thermal print mechanisms without the need for tools. Additionally, the printer may include an optional modular thermal transfer ribbon assembly for printing on plain paper labels.

The printer may also be provided with electronics reconfigurable to accommodate a variety of thermal print mechanisms and the optional thermal transfer ribbon. Configuration information may be stored in memory, read by a microprocessor, and used to configure a programmable device such a field programmable gate array ("FPGA") to allow print data received by the microprocessor to pass through the FPGA and be printed by the print mechanism loading in the printer. Configuration information may include parameters such as printer model, which includes motor type and printer head type.

According to the invention, loading of stock is greatly facilitated. Further, the printer is readily reconfigurable to accommodate an optional thermal ribbon cartridge and a variety of thermal print mechanisms which are easily removed and replaced without the need for tools or special alignment techniques.

BRIEF DESCRIPTION OF THE DRAWINGS

The invention, in accordance with preferred and exemplary embodiments, together with further advantages thereof, is more particularly described in the following detailed description taken in conjunction with the accompanying drawings in which.

DESCRIPTION

Figure 1:
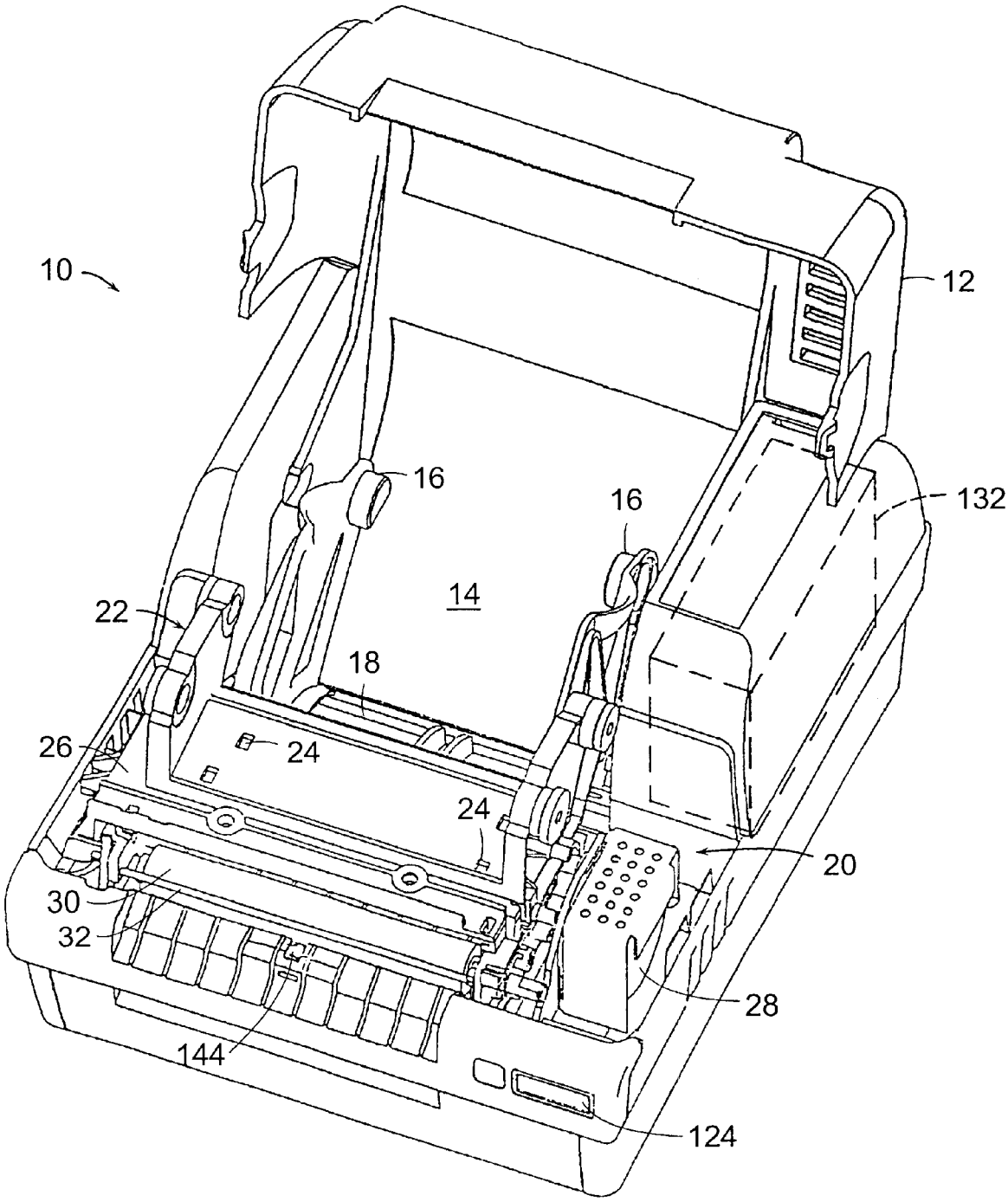
FIG. 1 is a schematic perspective view of a thermal printer in accordance with an embodiment of the invention.

FIG. 1 shows a schematic perspective view of a thermal label printer 10 in accordance with an embodiment of the invention. The printer 10 includes a cover 12, depicted in an open position to show the arrangement of the printer components. A storage well 14 is provided for a roll of stock (e.g., label stock). The stock is supported on edge guides 16 which slide on track 18. The track 18 may include a centrally disposed, spring loaded pinion which cooperates with racks formed on the edge guides 16 to automatically center the roll of label stock without the need for manual adjustment.

The printer 10 includes a printer subassembly 20 for conveying, printing, and dispensing labels. The subassembly 20 includes an optional modular thermal transfer ribbon assembly 22, solely the frame of which is depicted here. The ribbon assembly 22 includes a plurality of hooks 24 formed in a base portion thereof which interlock with mating tab features disposed in an upper surface of a pressure plate 26 to facilitate rapid installation and removal without the need for tools. As will be discussed in greater detail hereinbelow, the pressure plate 26 captures and supports one of a variety of thermal print mechanisms, not depicted in this view.

The subassembly 20 also includes a motor 28, preferably a step motor, and associated gear train for driving the ribbon assembly 22 and a platen roller 30. The platen roller 30 supports the stock during printing and may be covered with rubber to provide a resilient surface for label stock and a coefficient of friction sufficient to ensure positive tracking of the stock through the nip formed with a printer head of the thermal print mechanism. As used herein, the term "nip" refers to a pinch line through which label stock or web backing passes. The nip may be formed by a cylindrical roller, such as the platen 30, and a stationary element, such as a printer head. Alternatively, the nip may be formed by a pair of cylindrical rollers. There may be rolling contact between the rollers or sliding contact between the roller and stationary element, or alternatively there may be a nominal clearance. A peeler bar 32 is provided close to and spaced from the platen 30 and generally aligned with an uppermost surface of the platen 30 in a parallel arrangement to facilitate delamination of labels from a web backing after printing.

Figure 2:
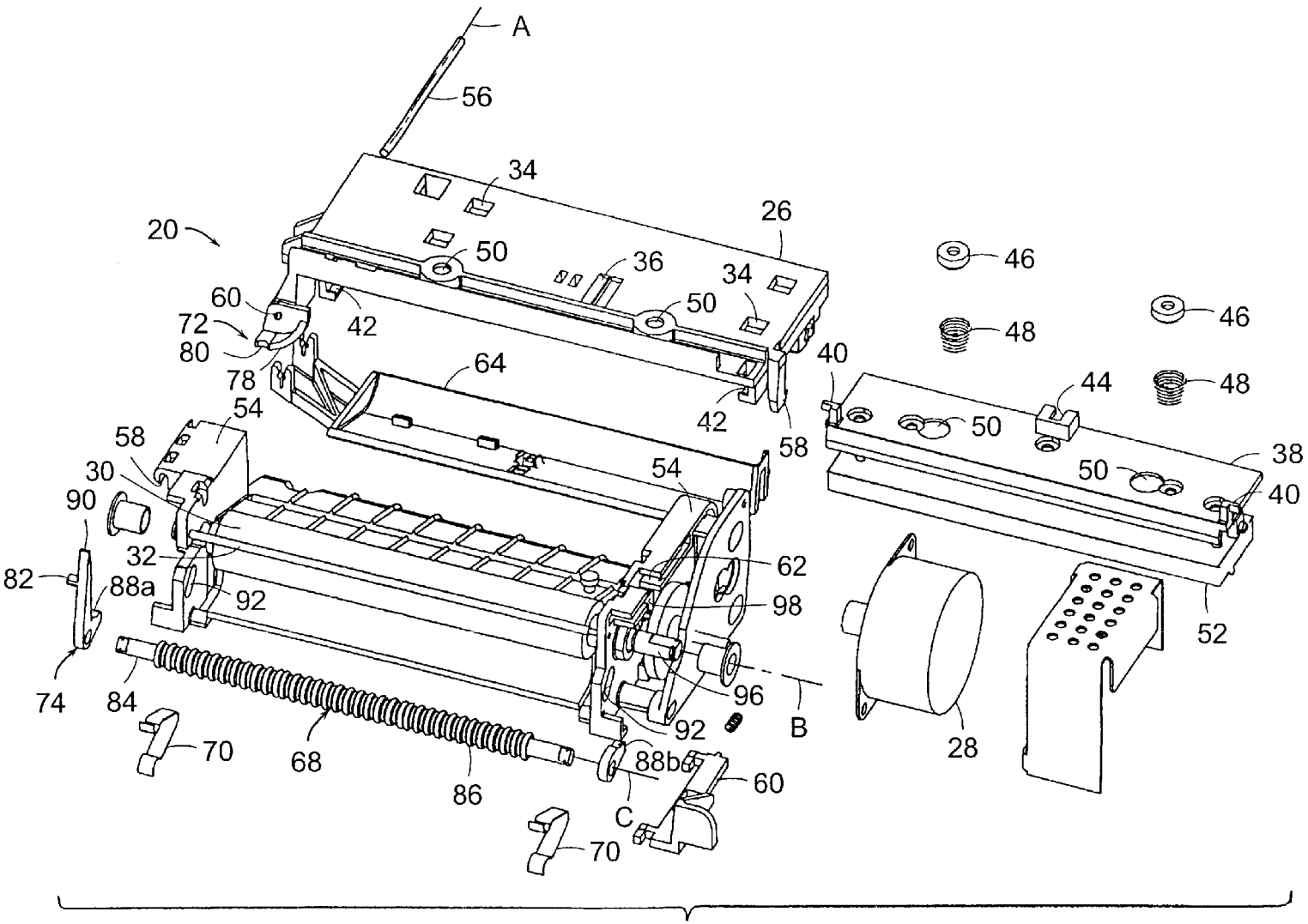
FIG. 2 is a schematic perspective exploded view of a subassembly of the printer depicted in FIG. 1.

Referring now to FIG. 2, the printer subassembly 20 is shown in an exploded perspective view without the ribbon assembly 22. In this view, the tab features of the pressure plate 26 are apparent and may be apertures 34 sized to receive the hooks 24 of the ribbon assembly 22. The hooks 24 are sized with an opening or throat substantially equivalent to the thickness of the pressure plate 26. A registration feature such as a depression 36 may be provided to accommodate a protuberance on the ribbon assembly 22 so that the ribbon assembly snaps in place upon installation.

A thermal print mechanism alignment plate 38 is removably captured by the pressure plate 26 by a pivot feature which includes alignment plate hooks 40 and pressure plate tabs 42. A rearwardly opening, centrally disposed "T" slot 44 on the alignment plate mates with a "T" on an underside of the pressure plate 26. Plungers 46 and springs 48 are captured in mating recesses 50 in both the pressure plate 26 and the alignment plate 38 to resiliently bias the alignment plate 38 away from the pressure plate 26. A thermal print mechanism or printer head 52 is fixedly attached to an underside of the alignment plate 38 remote from the pressure plate 26, for example with machine screws. Accordingly, the alignment plate 38 and the printer head 52 remain centered relative to the pressure plate 26 and can pivot and translate, within limits, to ensure intimate contact between the printer head 52 and a label disposed on the platen 30 and consistent, high quality print resolution. The alignment plate 38 and printer head 52 may be readily installed in the pressure plate 26 by squeezing the plates 26, 38 together to compress the springs 48 and translating the alignment plate rearwardly toward the label stock roll. Removal of the alignment plate 38 is achieved by squeezing and translation in a forwardly direction toward the peeler bar 32.

Figure 3:
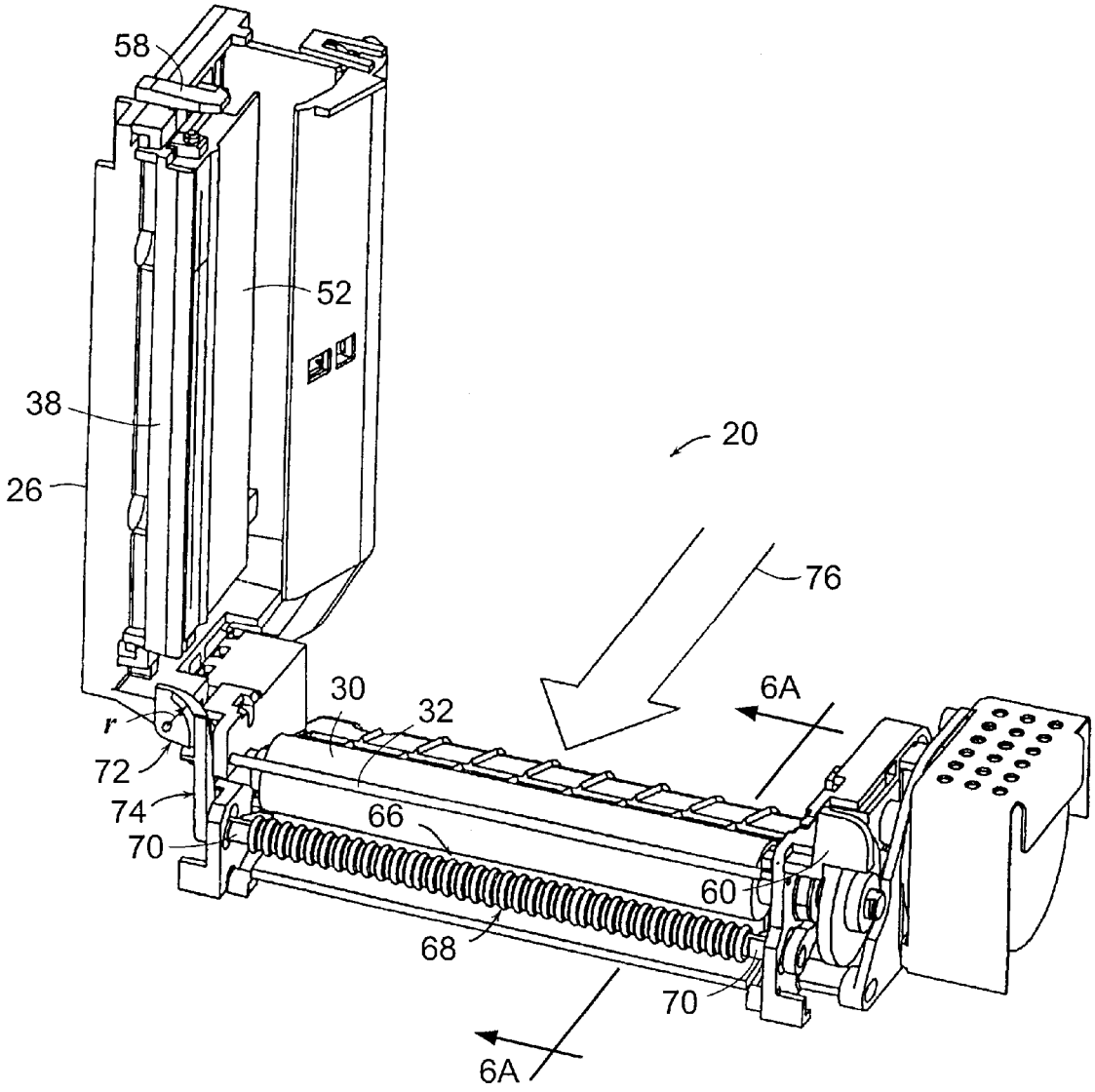
FIG. 3 is a schematic perspective view of the subassembly depicted in FIG. 2 in an assembled state open position.

The pressure plate 26 is hinged along a side thereof to a base housing or frame 54 by a hinge pin 56 which passes through respective apertures 58, 60. A longitudinal axis "A" of the hinge pin 56, when installed, is substantially perpendicular to an axis of rotation "B" of the platen roller 30. An opposite edge of the pressure plate 26 includes a hook 58 configured to mate with a spring loaded latch 60 slidably disposed in slot 62 in the frame 54. Accordingly, the pressure plate 26 can be latched in a closed position with the printer head 52 resiliently biased against the platen 30, forming a nip for printing. Translation of the latch 60 in a rearward direction releases the hook 58 and the pressure plate 26 can be rotated or swung upwardly to the left, as depicted in FIG. 3, so that label stock may be inserted or so that the printer head 52 can be cleaned, removed, or replaced. A contoured ramp 64 may be provided which is hinged on hinge pin 54 rearwardly of the platen roller 30 to ride above the label stock and ensure smooth entry of the label stock into the printer head nip. A sensor or switch such as microswitch 98 may be provided proximate the latch 60 in the subassembly 20 to sense whether the pressure plate 26 is in the closed or open position.

The peeler bar 32 is disposed forwardly of the platen 30 and provides a small radius contour around which the label stock can be turned at an acute angle to delaminate a leading edge of a printed label from the web backing. To maintain close conformance of the web to the peeler bar 32 and keep the web taut, a pinch or peeler roller 68 is provided. The peeler roller 68 has an axis of rotation "C" substantially parallel with the platen axis B and is biased against the platen 30 by a pair of flat springs 70 to form a second nip. Solely the web passes through the second nip since the printed labels become detached from the web as the web passes over the peeler bar 32.

FIG. 3 is a schematic perspective view of the printer subassembly 20 depicted in FIG. 2 in an assembled state with the pressure plate 26 in a fully open position to facilitate threading of the label stock across the platen 30 and peeler bar 32. To facilitate threading of the roller nip 66 with the web, an actuation mechanism 72 is provided on the pressure plate 26 and a cooperating follower 74 is coupled to the roller 68. When the hook 58 is released from the latch 60, pressure plate 26 is moved about hinge axis A from a closed position substantially parallel to the platen axis to an open position substantially perpendicular to the platen axis. The actuation mechanism 72 reacts against follower 74 to cause translation of the roller 68 away from the platen 30. The label stock may be readily laid across the platen 30 and peeler bar 32 as shown by arrow 76 and the web thereafter passed through the gap created between the roller 68 and the platen 30 as will be discussed in greater detail hereinbelow.

As best seen in FIG. 2, the actuation mechanism 72 is a cam sector 78 of about 90 degrees corresponding to the 90 degree swing of the pressure plate 26. Smaller or larger angles may be employed if desired, depending on a particular application. The sector 78 has a substantially constant radial dimension relative to hinge pin axis A and a varying axial dimension. The axial dimension varies smoothly as a function of angle and may include a discontinuity or detent 80 proximate an end of the sector 78 substantially corresponding to end of travel of the pressure plate 26 at the fully open position of about 90 degrees. The follower 74 includes an axially extending pin 82 for sliding contact on the sector 78 and for engagement with the detent 80 at full pressure plate travel. Accordingly, as the pressure plate 26 is rotated from closed to open positions, the sector 78 drives the pin 82 in a forward direction.

The follower 74 is coupled to a shaft 84 of the roller 68, for example, with a mating "D" slot and flat to prevent relative rotation therebetween, although other techniques could be used including a key or spline connection. One or more cylindrical roller elements 86 with or without ridges or other surface features may be provided which freely rotate relative to the shaft 84. The follower 74 also includes a cam surface 88*a* for reacting against proximate structure as will be discussed in greater detail hereinbelow. A matching cam surface 88*b* is provided at an opposite end of the roller 68 which is similarly coupled to the shaft 84 by a mating "D" slot and flat. Lastly, the follower 74 includes an extension 90 for manual translation of the roller 68 away from the platen 30 when the pressure plate 26 is closed and latched. The roller shaft 84 passes through a pair of elongated slots 92 to limit manual translation of the roller 68.

Figure 4A:
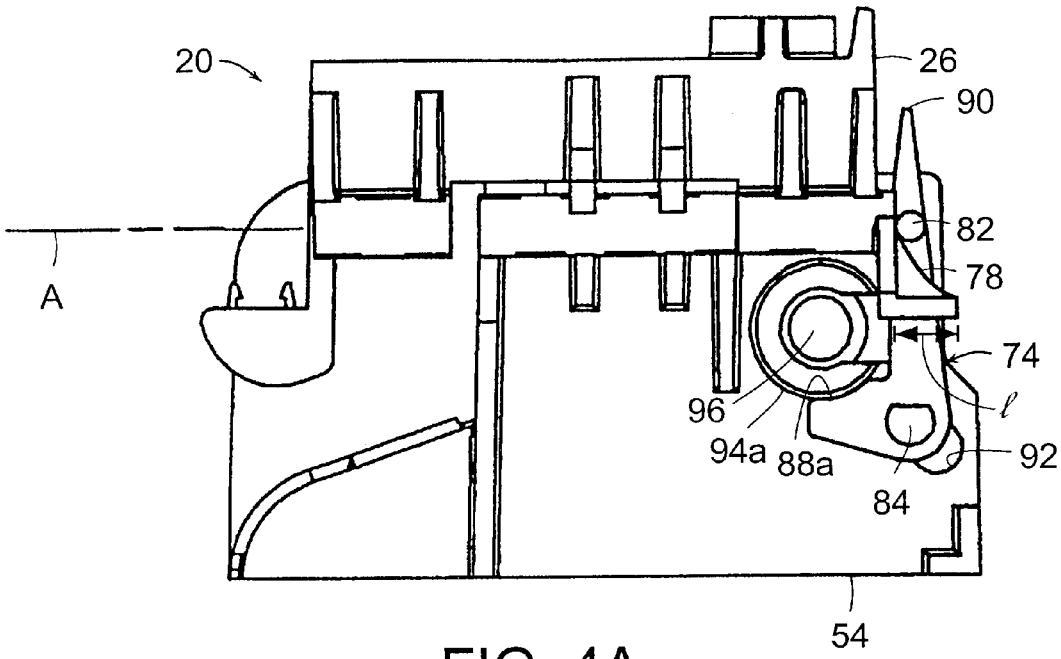
FIG. 4A is a schematic left side view of the subassembly depicted in FIG. 2 in an assembled state closed position.
Figure 4B:
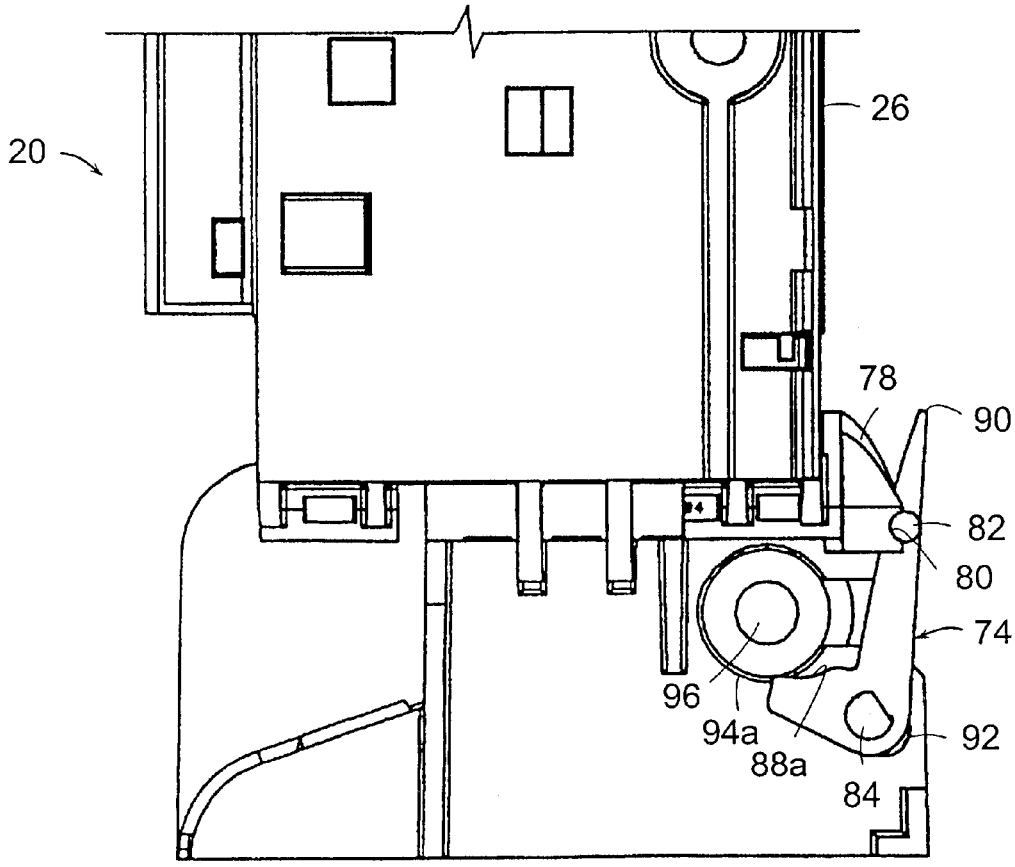
FIG. 4B is a schematic left side view of the subassembly depicted in FIG. 4A in an open position.

FIGS. 4A and 4B depict schematic left side views of the subassembly 20 depicted in FIG. 2 in assembled state in closed and open positions, respectively. With the pressure plate 26 in the closed position shown in FIG. 4A, follower pin 82 is biased against a portion of the sector 78 having a minimum axial dimension and follower cam surface 88*a* is fully engaged with a bushing 94*a* which circumscribes a shaft 96 of the platen roller 30. The pin 82 is substantially aligned at a common height with hinge pin axis A. As the pressure plate 26 is raised to the open position depicted in FIG. 4B, the pin 82 slides along sector 78 until engagement with detent 80. The follower 74 becomes canted as the roller shaft 84 is rotated. The shaft 84 translates in slot 92 due to the reaction of cam surface 88*a* against bushing 94*a*.

Figure 5A:
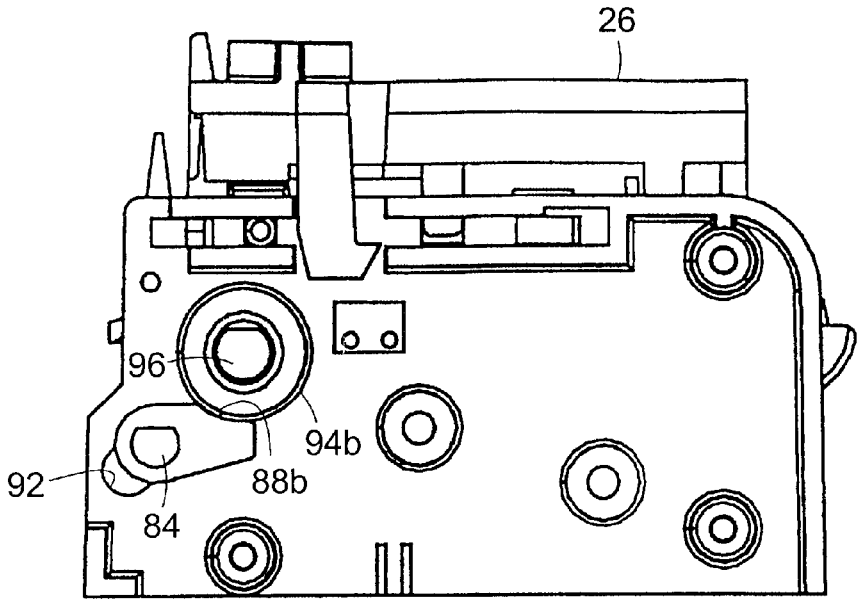
FIG. 5A is a schematic right side view of the subassembly depicted in FIG. 2 in an assembled state closed position.
Figure 5B:
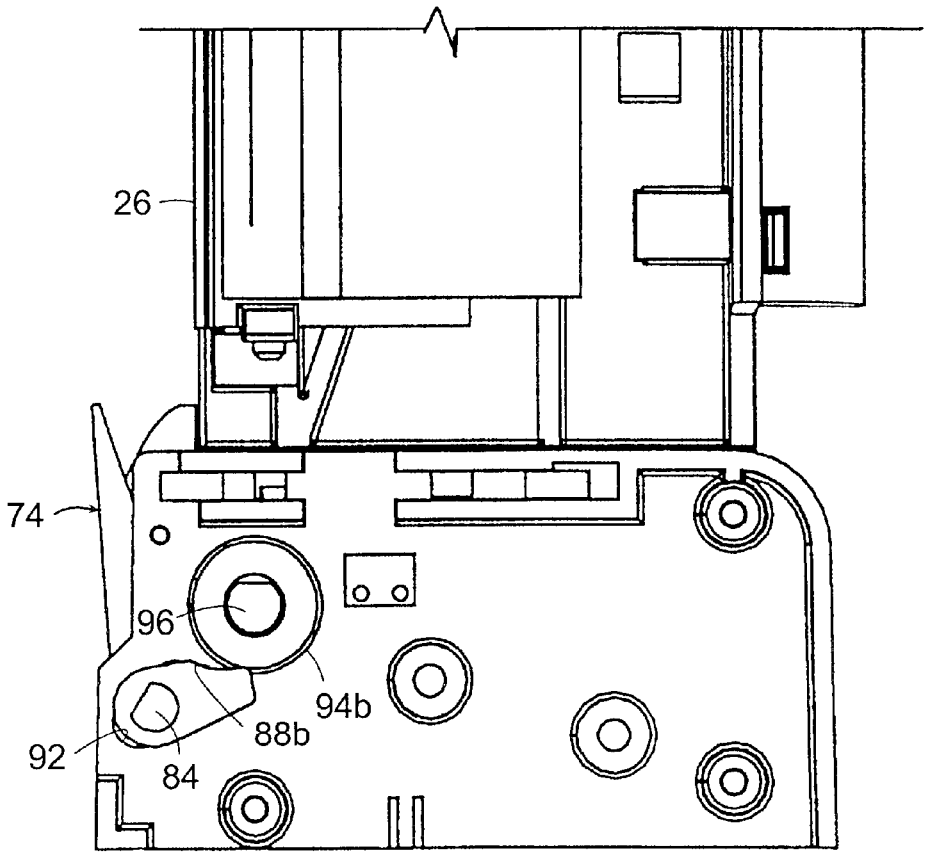
FIG. 5B is a schematic right side view of the subassembly depicted in FIG. 5A in an open position.

In order to effect substantially parallel translation of the roller 68 relative to the platen 30 upon movement of the follower 74, a similar arrangement of cam surface 88*b* and bushing 94*b* are provided at the opposite end of shaft 84 as depicted in FIGS. 5A and 5B. With the pressure plate 26 in the closed position shown in FIG. 5A, the cam surface 88*b* is fully engaged with the bushing 94*b* which circumscribes platen roller shaft 96. As the pressure plate 26 is raised to the open position depicted in FIG. 5B, the follower 74 rotates roller shaft 84 and this end of the roller shaft 84 translates in slot 92 due to the reaction of cam surface 88*b* against bushing 94*b*.

Figure 6A:
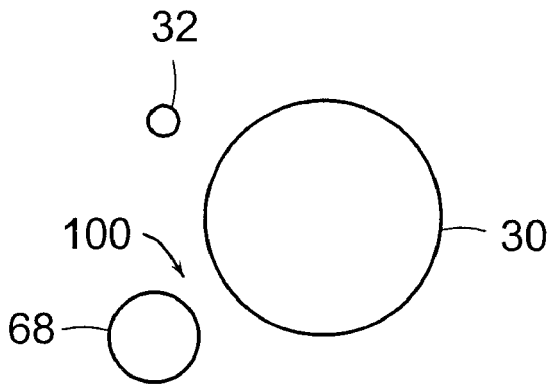
FIG. 6A is a schematic sectional view of a portion of the subassembly depicted in FIG. 3 in an assembled state open position taken along line 6A—6A of FIG. 3.
Figure 6B:
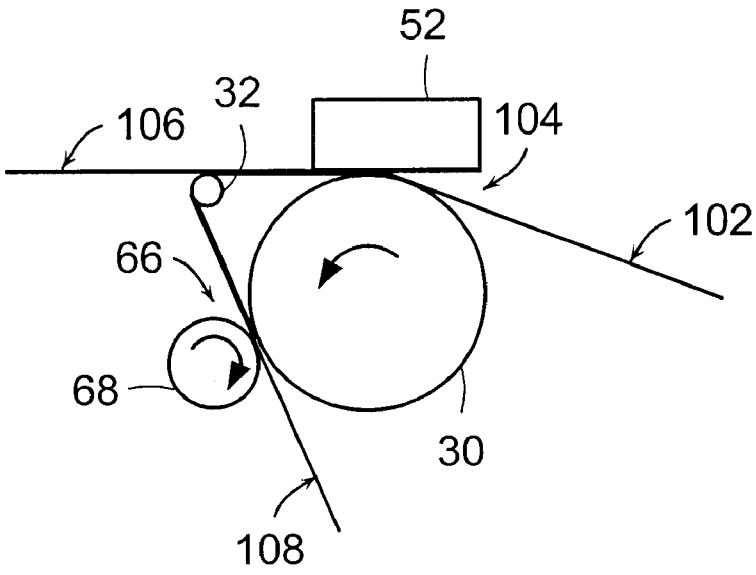
FIG. 6B is a schematic sectional view of a portion of the subassembly depicted in FIG. 6A in a closed position.

FIGS. 6A is a schematic sectional view of a portion of the subassembly 20 depicted in FIG. 3 in the open position taken along line 6A—6A thereof The roller 68 is spaced from the platen 30 leaving a gap 100 therebetween. The printer head 52 has been swung out of the way providing access to thread the label stock and web. FIG. 6B is a schematic sectional view of the portion of the subassembly 20 depicted in FIG. 6A in a closed position with a label stock and web path depicted. Label stock 102 enters a nip 104 formed by the printer head 52 and the platen 30. After exiting the nip 104, the label stock 102 passes around peeler bar 32 at an acute angle, delaminating a label 106 from the web carrier backing 108 which passes through the nip 66 formed by the roller 68 and platen 30.

In an exemplary embodiment, the platen 30 may be manufactured as a rubber covered roller having a length of up to about 4.5 inches (11.4 cm) and a nominal diameter of about 0.687 inches (1.74 cm). The labels may vary in size from about 1.0 inches (2.5 cm) along a side, or less, to about 4.0 inches (10.2 cm), or more. Label thickness may range from about 0.002 inches (0.005 cm) or less to about 0.015 inches (0.038 cm) or more. The peeler bar 32 may be manufactured from stainless steel for corrosion resistance and be a cylindrical member having a nominal diameter of about 0.094 inches (0.24 cm). The roller 68 may include a stainless steel shaft 84 with three roller elements 86 manufactured from acetyl resin. The roller elements 86 may have a nominal diameter of about 0.25 inches (0.64 cm) and include a plurality of axially spaced circumferentially disposed ridges having a maximum diameter of about 0.28 inches (0.71 cm).

The actuation mechanism 72 on the pressure plate 26 may have a sector 78 with a radius "r" of about 0.375 inches (0.953 cm) as best seen in FIG. 3 and an axial dimension "1" of about 0.25 inches (0.64 cm) as best seen in FIG. 4A. The follower pin 82 may have a nominal diameter of about 0.125 inches (0.318 cm) to match the contour of the detent 80 in the sector 78. Distance between a centerline of the pin 82 and the axis of rotation C of roller 68 is about 0.75 inches (1.9 cm). For these dimensions, the gap 100 created by fully opening the pressure plate 26 and engaging the pin 82 with the detent 90 is about 0.10 inches (0.25 cm). Clearly, the dimensions of the actuation mechanism 72 and follower 74 may be changed to either increase or decrease the size of the gap 100, as desired. By employing the actuation mechanism 72 and follower 74 according to the invention, a compact low profile configuration for automatically opening the roller nip 66 can be produced. The actuation mechanism 72 may be formed integrally with the pressure plate 26 from a polycarbonate resin such as LEXAN™ available from General Electric Company, Pittsfield, Mass. The follower 74 may also be manufactured from polycarbonate resin. Alternatively, the actuation mechanism 72 and follower 74 may be manufactured from reinforced glass filled polymers or metals such as aluminum or stainless steel to enhance strength and wear resistance.

Figure 7:
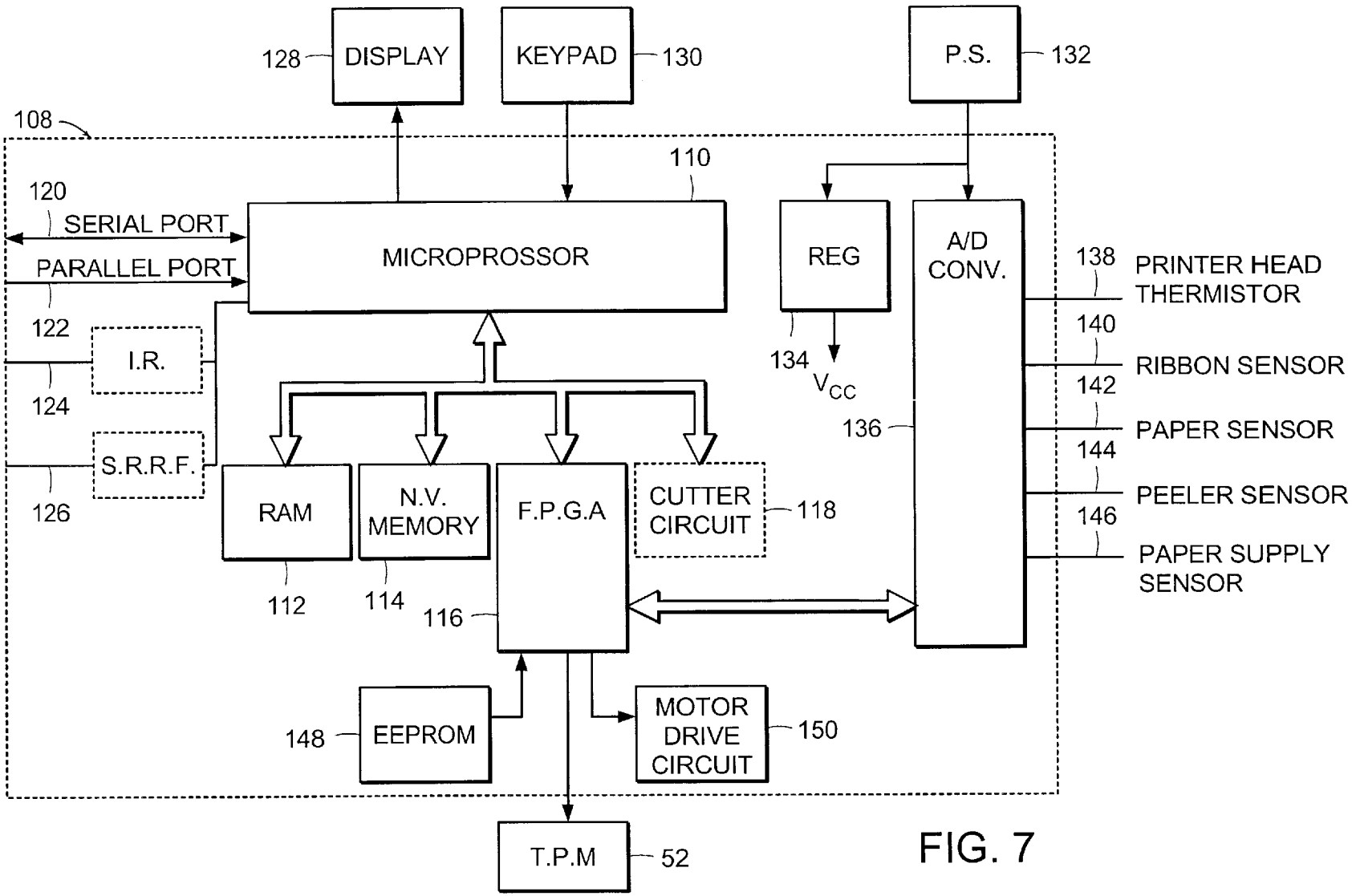
FIG. 7 is a block diagram of printer electronics and connections thereto by other components of the printer in accordance with an embodiment of the present invention.

FIG. 7 is a block diagram of printer electronics 108 and connections thereto by other components of the printer 10. The electronics 108 include a microprocessor 110 coupled by a data/address bus to volatile memory 112 (preferably RAM), non-volatile memory 114 (e.g., ROM, flash memory, etc.), and a programmable device 116 such as a field programmable gate array (FPGA). The RAM 112 functions as a scratch pad memory, with data being written to it prior to printing of a label. The non-volatile memory 114 includes printer operating system and application software such as non-standard fonts, non-standard bar codes, and printer head variables. The non-volatile memory 114 also includes an FPGA configuration file having printer head connections and printer head parameters for a variety of physically interchangeable thermal print mechanisms 52. The non-volatile memory 114 may be a user-accessible, replaceable printed circuit card to facilitate memory upgrade. While permanent memory such as flash memory is preferred for the non-volatile memory 114, battery-backed RAM could be used if desired.

The FPGA 116 is connected to a serial EEPROM 148, a motor drive circuit 150 for controlling step motor 28, and one of a variety of thermal print mechanisms 52. Configuration information such as printer model, which includes motor type and printer head type, may be stored in the serial EEPROM 148. Printer head type may be, for example, a non-intelligent print mechanism or an intelligent print mechanism. A non-intelligent print mechanism may have a resolution of between about 200 dots per inch ("dpi") (79 dots/cm) and 300 dpi (118 dots/cm) and the capability to print at about 2 inches per second ("ips") (5 cm/sec) to about 3 ips (8 cm/sec). Alternatively, an intelligent print mechanism may have a resolution of about 200 dpi (79 dots/cm) but be capable of printing at speeds as high as 7 ips (18 cm/sec) or faster due to the inclusion of circuitry within the printer head as well as dot history control. An intelligent print mechanism is commercially available from Rohm Co., Ltd. of Kyoto, Japan. Depending on whether an intelligent or non-intelligent print mechanism is installed in the printer 10 configuration information for motor type may include parameters such as motor direction and speed data. These parameters may be set to correspond to different gear trains installed in the printer 10 between the motor 28 and platen 30 so that the platen 30 is driven at an optimum speed for the installed print mechanism 52.

An optional cutter circuit 118 may also be connected to the bus to control an optional guillotine or rotary cutter disposed downstream of the printer head nip 104 for cutting variable length labels produced from linerless stock or other continuous label stock.

The microprocessor 110 communicates externally by means of a serial port 120, parallel port 122, or for non-cabled communications an optional infrared ("IR") port 124 or an optional short range radio frequency ("SRRF") port 126. A display 128 is also provided and may be a digital format liquid crystal display ("LCD") or a plurality of light emitting diodes ("LED") corresponding to "power", "label stock out", "on line", etc. A keypad 130 permits manual input by an operator and may be an alphanumeric pad or a series of discreet function switches such as "on/off", "feed label stock", "cut label stock", etc.

An internal battery or external power supply 132 is provided to energize the electronics 108 which may include a regulator circuit 134 for conditioning the power to a nominal voltage, $V_{cc}$, for example 5 volts, provided to. the various components of the electronics 108. The electronics 108 also includes a multi-channel analog-to-digital (A/D) converter 136 in communication with the FPGA 116. The A/D converter 136 is connected to a plurality of printer sensors such as printer head thermistor 138 for sensing printer head temperature, ribbon sensor 140 to detect the presence of thermal transfer ribbon, paper sensor 142 to detect label stock in the printer head nip 104, peeler sensor 144 to detect a dispensed label not yet removed from the area of the peeler bar 32, and a paper supply sensor 146 for detecting when a roll of label stock disposed in the well 14 on the edge guides 16 is low. Since less energy is required for printing with a thermal ribbon, print mechanism activation or strobe times are decreased relative to printing on thermal paper labels without the thermal ribbon. The ribbon sensor 140 may be disposed in any of a variety of locations in the printer 10, for example on the ramp 64 or frame 54, in order to detect presence or absence of thermal ribbon in the general area of the printer head nip 104.

In an exemplary embodiment, the microprocessor 110 of the printer electronics 108 is a Motorola 68340 microprocessor, the RAM 112 is 512 k bytes of RAM, the non-volatile memory 114 is 256 k bytes of non-volatile flash memory, and the FPGA 116 is a Xylinx XC3020A chip. The sensors may be infrared diode (emitter) and detector pairs which go high if there exists reflection from a white surface such as a label or web.

Figure 8A:
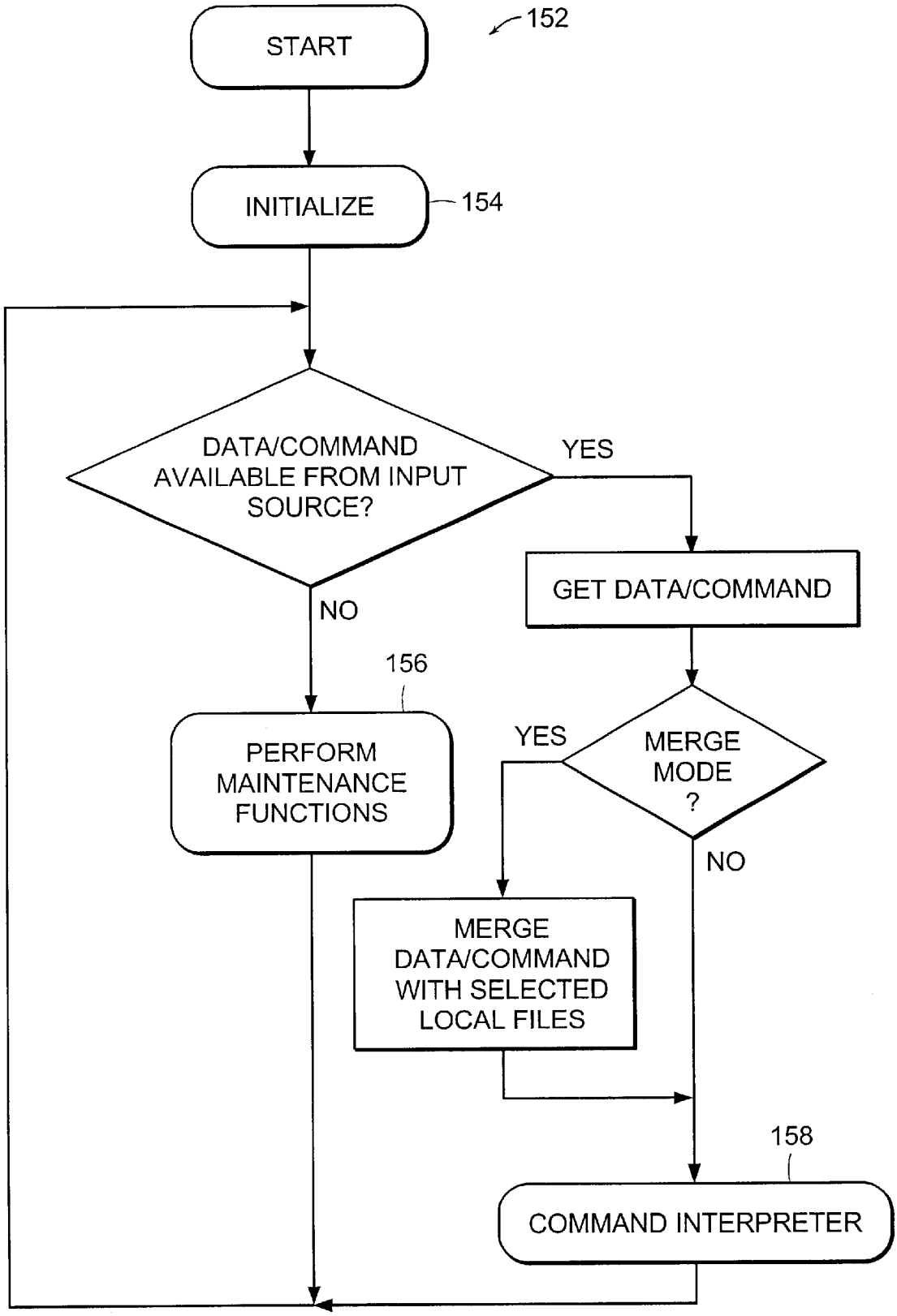
FIG. 8A is a flowchart of the operation of a printer operating system.
Figure 8B:
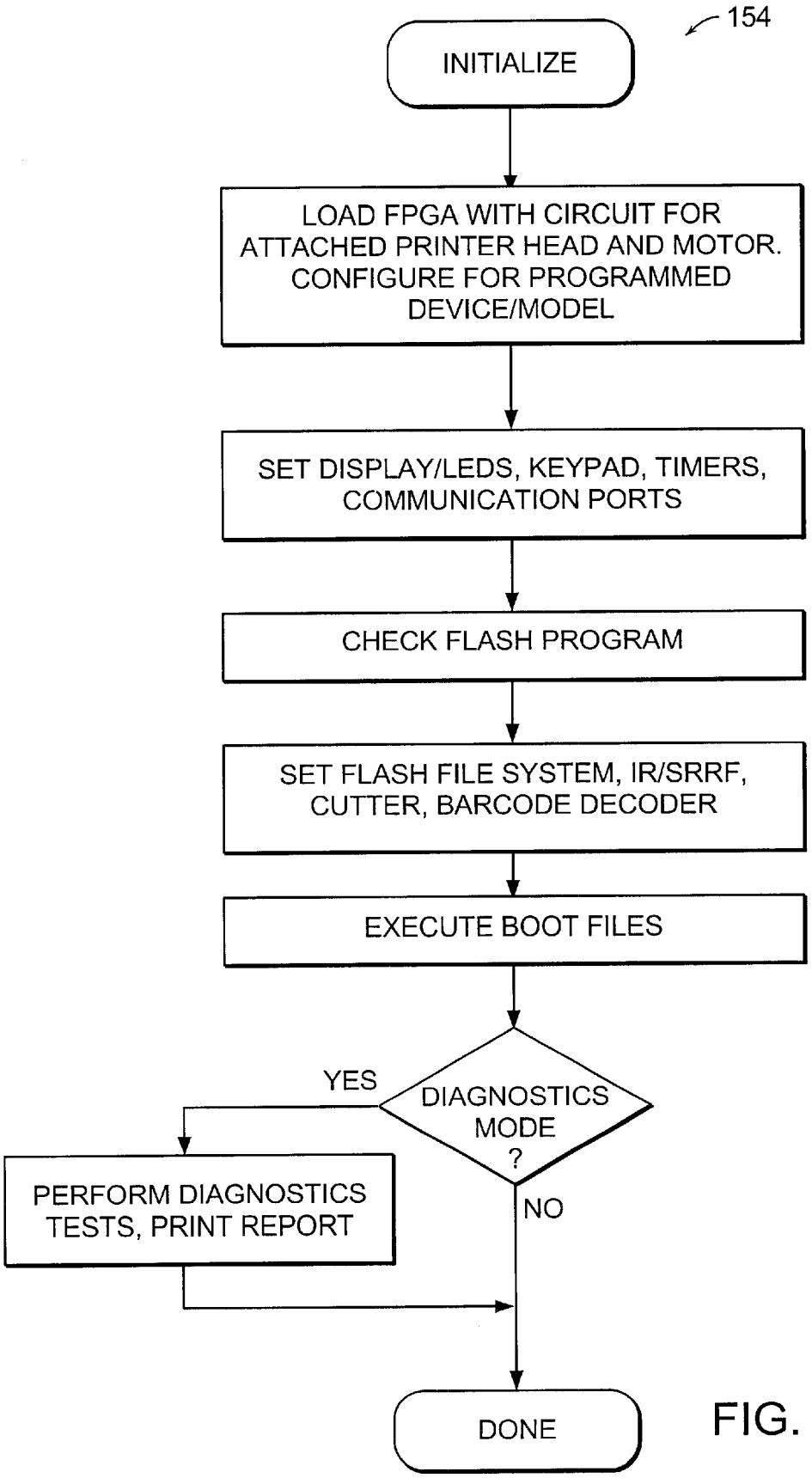
FIG. 8B is a flowchart of an initialization subroutine of the operating system depicted in FIG. 8A.

FIG. 8A is a flowchart of a printer operating system operation 152 in accordance with an embodiment of the present invention. A first step 154 is an initialization subroutine which is shown in FIG. 8B. Referring to FIG. 8B, the FPGA 116 is configured for the printer head 52 and step motor 28 installed in the printer 10. Thereafter, the display 128 and keypad 130 are set up, timers reset, and communications ports such as the serial port 120, parallel port 122 and optional IR and SRRF ports 124, 126 set. The flash program in the non-volatile memory 114 is checked and any boot files executed. By depressing a feed key on the keypad 130 when the printer is first powered on, the printer 10 enters a diagnostic mode during initialization in which a series of diagnostic tests are performed and a report printed.

Figure 8C:
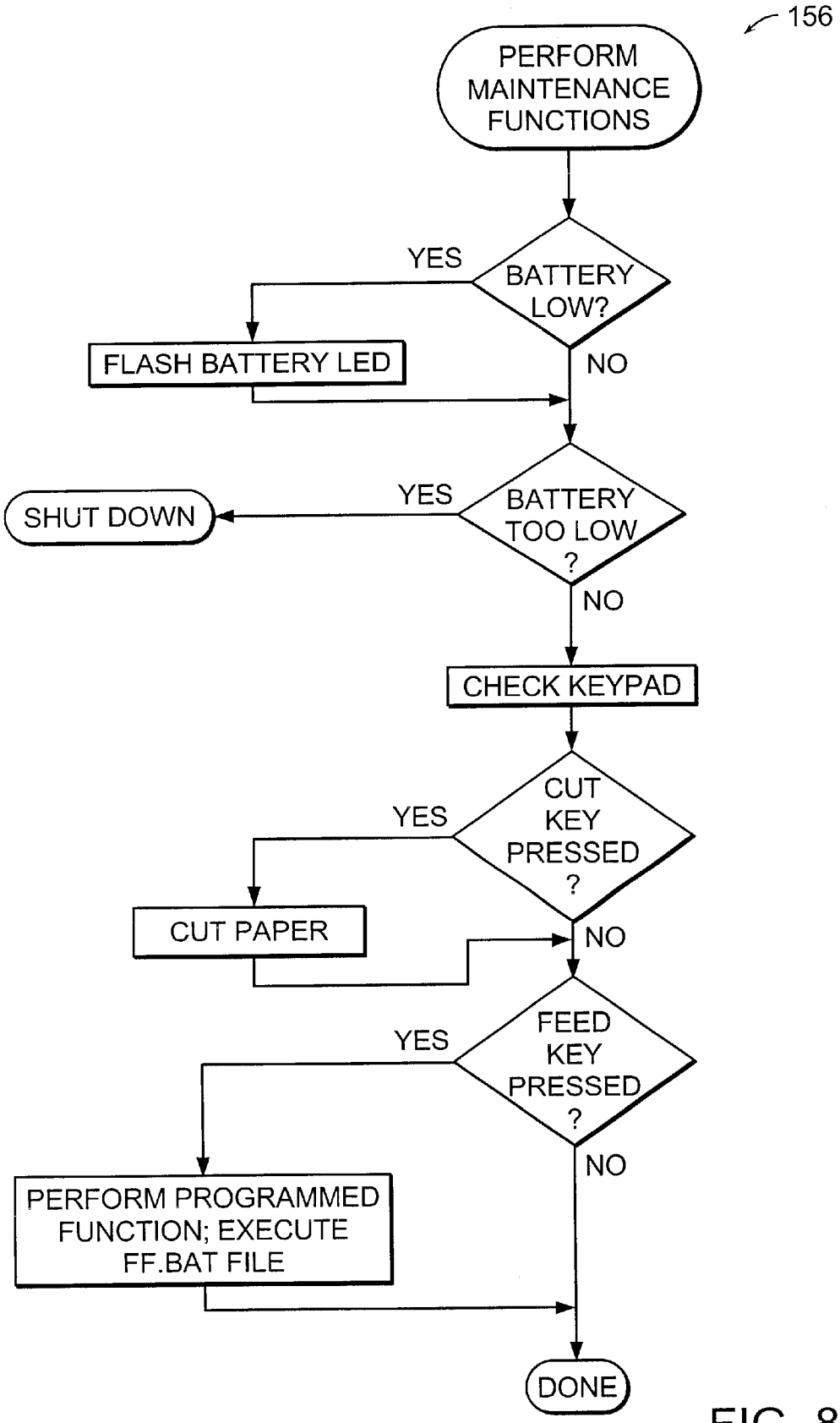
FIG. 8C is a flowchart of a maintenance subroutine of the operating system depicted in FIG. 8A.

Referring once again to FIG. 8A, once initialization has been completed, all communications ports and input devices, such as the keypad 130 or optionally a bar-code scanner, are checked for data or commands. If there is none, a maintenance function step 156 is performed. As shown in FIG. 8C, the maintenance subroutine includes checks of any internal batteries or external power supply 132 with appropriate flashing LED indication for low battery and shut down for discharge condition. The keypad 130 is also checked and the optional cutter energized if the cut key is pressed. A programmed function is run if the feed key is pressed. Depending on a particular application, the programmed function can include feeding the label stock 102, reprinting the last label 106, or taking no action.

Figure 8D:
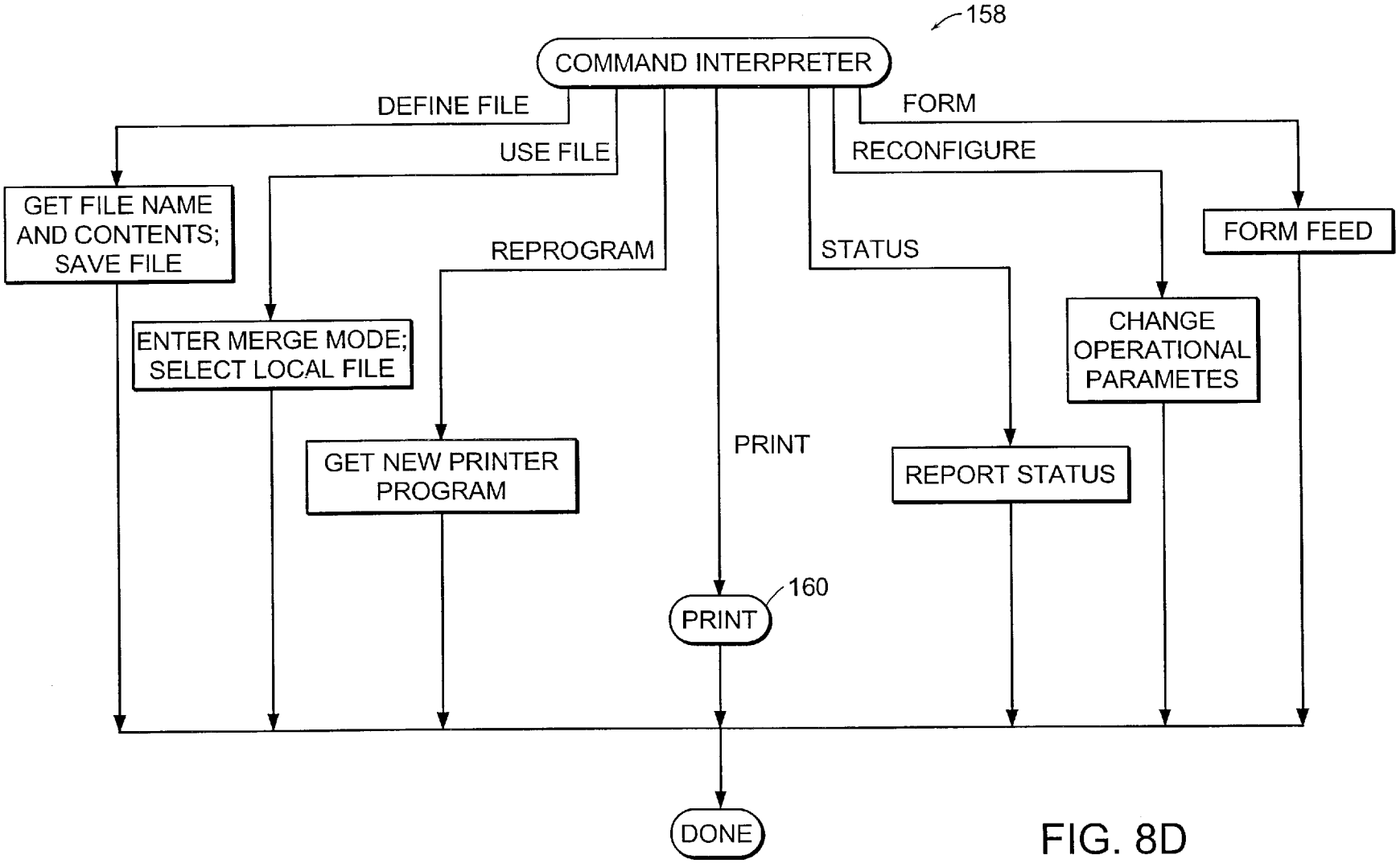
FIG. 8D is a flowchart of a command interpreter subroutine of the operating system depicted in FIG. 8A.

Referring again to FIG. 8A, if data or a command is available from an input source, the data or command is retrieved and merges with selected local files if the printer 10 is in a merge mode. In the alternative, a command interpreter step 158 executes one of a variety of functions, as shown in FIG. 8D, such as define file, use file, reprogram, form, reconfigure, status, and print. In the define file function, a file name and the contents thereof are retrieved and the file saved. In the use file function, merge mode is entered and a local file selected. In the reprogram function, a new printer program is retrieved through either the serial port 120, parallel port 122, or optional IR or SRRF ports 124, 126. The form function executes a form feed, for example, advancing the label stock for a predetermined time period, a preselected distance, or until a next label is registered for printing. The reconfigure function changes operation parameters of the printer 10 such as baud rate, serial number, memory size, etc. The status function reports printer status such as condition of the battery, label stock supply, latch microswitch position, printer head contrast, software version, serial number, label odometer, etc.

Figure 8E:
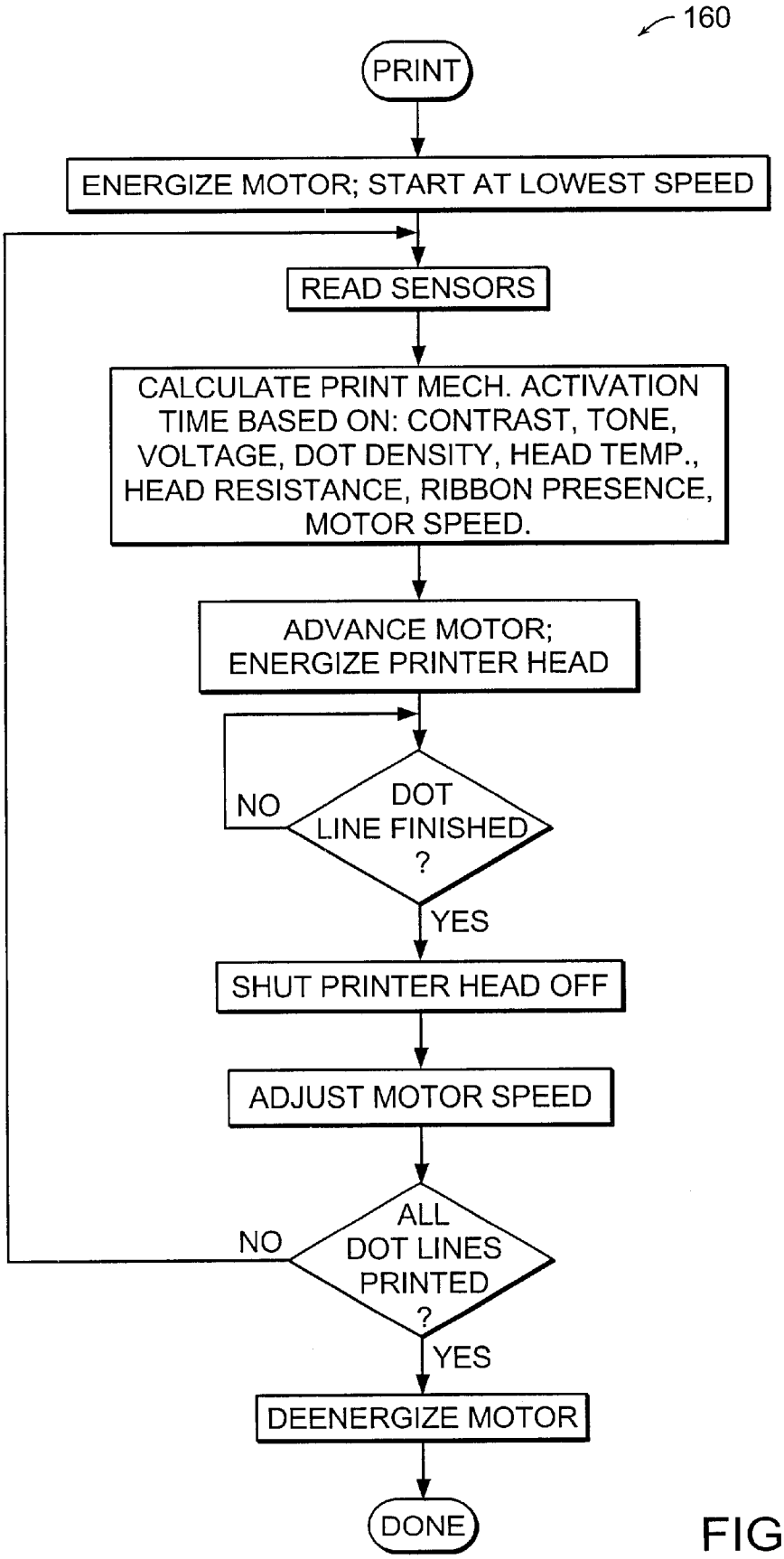
FIG. 8E is a flowchart of the print subroutine of the command interpreter subroutine depicted in FIG. 8D.

If a print command is received, the command interpreter 158 enters a print step 160 as depicted in FIG. 8E. The motor 28 is energized and the label stock 102 feed through the printer head nip 104 at low speed. Sensors such as ribbon sensor 140 are read so that printer head activation time can be calculated. Activation time is a function of a number of parameters including contrast, tone, voltage, dot density, printer head temperature read from the printer head thermistor 138, thermal transfer ribbon presence, and motor speed. The motor 28 is stepped until all dot lines for the label 106 have been printed. Thereafter, the software loops, as depicted in FIG. 8A, awaiting additional data or commands.

While there have been described herein what are to be considered exemplary and preferred embodiments of the present invention, other modifications of the invention will become apparent to those skilled in the art from the teachings herein. The particular methods of manufacture of discrete components and interconnections therebetween disclosed herein are exemplary in nature and not to be considered limiting. It is therefore desired to be secured in the appended claims all such modifications as fall within the spirit and scope of the invention. Accordingly, what is desired to be secured by Letters Patent is the invention as defined and differentiated in the following claims.

What is claimed is:

1. A printer subassembly, comprising:

a platen having an axis of rotation;

a pressure plate for aligning a printer head mountable thereon with the platen axis, the pressure plate including an actuation mechanism and being movable about an axis substantially perpendicular to the platen axis between a closed position substantially parallel to the platen axis and an open position;

a roller having an axis substantially parallel with the platen axis, the roller translatable between a first position in contact with the platen and a second position spaced from the platen; and a follower, coupled to the roller, for cooperating with the actuation mechanism as the pressure plate is moved between the closed and open positions to cause translation of the roller between the first and second positions.

2. The printer subassembly of claim 1 wherein the actuation mechanism comprises a cam sector having a substantially constant radial dimension and a varying axial dimension.

3. The printer subassembly of claim 2 wherein said sector includes a detent substantially corresponding to end of travel of the pressure plate at the open position.

4. The printer subassembly of claim 3 wherein the follower includes a pin for sliding contact on the sector and for engagement with the detent.

5. The printer subassembly of claim 2 wherein said roller includes a spring element for biasing the roller toward the platen.

6. The printer subassembly of claim 5 wherein at least one of the follower and the roller includes a cam surface bearing against proximate structure to effect translation of the roller relative to the platen upon movement of the follower.

7. The printer subassembly of claim 6 wherein the roller includes a second cam surface to effect substantially parallel translation of the roller relative to the platen upon movement of the follower.

8. The printer subassembly of claim 1 wherein the follower includes an extension for manual translation of the roller.

9. The printer subassembly of claim 8 further comprising a frame for supporting the roller, said frame forming slots through which ends of the roller pass to limit translation of the roller.

10. The printer subassembly of claim 1 further comprising:

an alignment plate having a pivot feature and a centering feature, said alignment plate removably captured by mating structure of the pressure plate; and a printer head mounted on the alignment plate remote from the pressure plate.

11. The printer subassembly of claim 10 further comprising at least one spring disposed between the pressure plate and the alignment plate for biasing the printer head mounted thereon toward the platen when the pressure plate is in a closed position.

12. The printer subassembly of claim 10 further comprising a peeler having an axis substantially parallel to the platen axis and disposed radially outwardly from the platen for changing direction of a web after passing through a nip formed by the printer head and the platen and before passing through a nip formed by the roller and the platen.

13. The printer subassembly of claim 1 further comprising a latch disposed remotely from the pressure plate axis for securing the pressure plate in the closed position.

14. The printer subassembly of claim 13 further comprising a switch for sensing the closed or open position of the pressure plate.

* * * * *

UNITED STATES PATENT AND TRADEMARK OFFICE

CERTIFICATE OF CORRECTION

PATENT NO. : 6,428,227 B2
DATED : August 6, 2002
INVENTOR(S) : Petteruti et al.

It is certified that error appears in the above-identified patent and that said Letters Patent is hereby corrected as shown below:

Title page,
Item [75], delete "Majid Amani, Coventry; David St. Jean, Chepachet, both of RI (US)".

Signed and Sealed this

Tenth Day of December, 2002

JAMES E. ROGAN
*Director of the United States Patent and Trademark Office*